US007696699B2

(12) United States Patent
Lerchegger et al.

(10) Patent No.: US 7,696,699 B2
(45) Date of Patent: Apr. 13, 2010

(54) LAMP BASE FOR A HIGH-PRESSURE DISCHARGE LAMP AND CORRESPONDING HIGH-PRESSURE DISCHARGE LAMP

(75) Inventors: Daniel Lerchegger, München (DE); Bernhard Sieβegger, München (DE)

(73) Assignee: Osram Gesellschaft mit Beschraenkter Haftung, Munich (DE)

( * ) Notice: Subject to any disclaimer, the term of this patent is extended or adjusted under 35 U.S.C. 154(b) by 221 days.

(21) Appl. No.: 11/884,337

(22) PCT Filed: Feb. 6, 2006

(86) PCT No.: PCT/DE2006/000180

§ 371 (c)(1),
(2), (4) Date: Aug. 13, 2007

(87) PCT Pub. No.: WO2006/084440

PCT Pub. Date: Aug. 17, 2006

(65) Prior Publication Data

US 2008/0150448 A1 Jun. 26, 2008

(30) Foreign Application Priority Data

Feb. 11, 2005 (DE) ..... 10 2005 008 301
Jun. 21, 2005 (DE) ..... 10 2005 029 001

(51) Int. Cl.
*H05B 39/00* (2006.01)

(52) U.S. Cl. ..... 315/177; 315/326; 315/206

(58) Field of Classification Search ..... 315/177, 315/326; 323/362, 363, 355
See application file for complete search history.

(56) References Cited

U.S. PATENT DOCUMENTS 3,703,677 A * 11/1972 Farrow ..... 363/133
4,495,446 A 1/1985 Brown et al.
6,441,713 B1 * 8/2002 Okuchi et al. ..... 336/178
7,135,822 B2 * 11/2006 Behr et al. ..... 315/57
2001/0026132 A1 10/2001 Yamamoto et al.

FOREIGN PATENT DOCUMENTS

EP 0886286 A 12/1998
EP 1278403 A 1/2003

* cited by examiner

*Primary Examiner*—Douglas W Owens
*Assistant Examiner*—Jianzi Chen
(74) *Attorney, Agent, or Firm*—Cohen Pontani Lieberman & Pavane LLP

(57) ABSTRACT

A lamp base (2) for a high-pressure discharge lamp comprises an ignition transformer (1000), which is placed in the interior (214) of the lamp base (2) and which serves to ignite the gas discharge inside the high-pressure discharge lamp. To this end, the ignition transformer (1000) comprises a core on which its windings (1001, 1002) are placed. The core is formed by a first core part (1004) and by at least one second core part (1005, 1006, 1007), which are each made of a ferromagnetic or ferrimagnetic material and are separated by at least one gap (10078). The first core part (1004) has a cylindrical section on which the windings (1001, 1002) of the ignition transformer (1000) are placed, and core parts (1004, 1005, 1006, 1007) are formed in such a manner that the core, apart from the at least one gap (1008), has a closed shape.

20 Claims, 6 Drawing Sheets

LAMP BASE FOR A HIGH-PRESSURE DISCHARGE LAMP AND CORRESPONDING HIGH-PRESSURE DISCHARGE LAMP

RELATED APPLICATIONS

This is a U.S. national stage of application No. PCT/DE2006/000180, filed on 6 Feb. 2006.

This patent application claims the priority of German patent application nos. 10 2005 008 301.3 filed 11 Feb. 2005 and 10 2005 029 001.9 filed 21 Jun. 2005, the disclosure content of which are hereby incorporated by reference.

FIELD OF THE INVENTION

The invention relates to a lamp base for a high-pressure discharge lamp and to a high-pressure discharge lamp.

BACKGROUND OF THE INVENTION

Such a lamp base has been disclosed, for example, in WO 97/35336. This document describes a lamp base for a high-pressure discharge lamp having an ignition transformer, which is arranged in the interior of the lamp base and has a closed core. In particular, the ignition transformer is in the form of a toroidal-core transformer. An ignition transformer having a closed core has the disadvantage that, owing to its high inductance during lamp operation after the end of the ignition phase, it impedes the change in polarity of the lamp current if the high-pressure discharge lamp is operated with a current of alternating polarity and the lamp current flows through the secondary winding of the ignition transformer. In addition, with such an ignition transformer the saturation state is reached quickly, with the result that it has a comparatively low energy storage capacity and, after the end of the ignition phase of the high-pressure discharge lamp, a comparatively high current flow occurs which can overload the electrical components of the operating device of the lamp since the inductor effect of the secondary winding of such an ignition transformer is comparatively low. In addition, the application of the transformer windings on to a toroidal core is complex.

WO 02/51214 has disclosed a lamp base having an ignition transformer, which is arranged in the interior of the lamp base and is in the form of a rod-core transformer. This ignition transformer generates a strong magnetic leakage field, which interacts with metallic parts of the lamp base and of the high-pressure discharge lamp and influences the lamp current. In particular, the leakage field causes a current flow in a metallic shielding housing, which surrounds the lamp base for the purpose of improving the electromagnetic compatibility. The current flow in the metallic shielding housing influences the change in polarity, i.e. the current zero phases, of the lamp current and can lead to the high-pressure discharge lamp being extinguished. In addition, the available ignition voltage is reduced owing to the losses in the shielding housing as a result of the magnetic alternating field emanating from the ignition transformer during the generation of the ignition voltage pulses. When a rod-core transformer is used as the ignition transformer, the ignition voltage pulses are considerably damped by the metallic shielding housing.

SUMMARY OF THE INVENTION

One object of the invention is to provide a lamp base for a high-pressure discharge lamp which avoids the abovementioned disadvantages of the prior art.

This and other objects are attained in accordance with one aspect of the present invention directed to a lamp base for a high-pressure discharge lamp has an ignition transformer, which is arranged in the interior of the lamp base, for igniting the gas discharge in the high-pressure discharge lamp, the core of the ignition transformer being formed by a first core component and at least one second core component, which each comprise a ferromagnetic or ferrimagnetic material and are separated by at least one gap, the first core component having a cylindrical section, on which the windings of the ignition transformer are arranged, and the core components being designed such that the at least one second core component bridges the cylindrical section of the first core component and produces a magnetic return path from a first end of the first core component to a second end of the first core component.

The at least two-part embodiment of the ignition transformer core ensures that the transformer core has at least one gap and therefore does not have the abovementioned disadvantages of the toroidal-core transformer in accordance with the prior art cited above. In particular, the secondary winding of the ignition transformer arranged in the lamp base according to the invention can therefore ensure sufficient limitation of the lamp current immediately after the ignition of the gas discharge in the high-pressure discharge lamp and can prevent an undesirably high rise in the lamp current. In addition, the cylindrical section of the first core component allows for a precise design and arrangement of the transformer windings either directly on the first core component or on a coil former, which surrounds the cylindrical section of the first core component. The formation of the at least two core components such that the at least one second core component bridges that section of the first core component which is provided with the windings and produces a magnetic return path from a first end of the first core component to a second end of the first core component (1004) reduces the leakage field of the ignition transformer considerably because the magnetic lines of force run virtually entirely in the core components consisting of ferromagnetic and ferrimagnetic material. This ignition transformer therefore does not induce any notable currents in a metallic shielding housing of the lamp base, which serves the purpose of improving the electromagnetic compatibility, and therefore does not have the disadvantages of the lamp base equipped with a rod-core transformer in accordance with the prior art cited above.

Preferably, the core components of the transformer core are arranged in the form of a U or form a frame, which is only interrupted by the at least one gap. That is to say, in the latter case, the core components of the transformer are arranged along a closed three-dimensional curve, which preferably runs in one plane.

The at least one second core component bridges the cylindrical section of the first core component such that it produces a magnetic return path from a first end of the first core component to a second end of the first core component. That is to say the magnetic lines of force emerging from the first end of the first core component are to a large extent passed back to the second end of the first core component by means of the at least one second core component.

The at least one gap is advantageously either in the form of an air gap or a material having a lower relative permeability than that of the ferromagnetic or ferrimagnetic core component material is arranged in the at least one gap between the core components in order to ensure sufficient energy storage capacity of the ignition transformer and the above-mentioned current-limiting effect of the secondary winding of the ignition transformer. The abovementioned material having a lower relative permeability is preferably an adhesive for connecting the at least two core components. As a result, no additional holders are required for the core components in order to fix them in the desired position and orientation. Alternatively, an electrical insulating casting compound can also be used instead of the adhesive, which casting compound fills the at least one gap between the core components of the ignition transformer and the chamber of the lamp base, in which the ignition transformer is arranged. A ferrite with a high resistivity, for example nickel-zinc ferrite, is preferably used as the material for the core components. As a result, one of the transformer windings, for example the secondary winding, can be wound directly onto the first core component.

The at least one gap between the core components of the ignition transformer advantageously has a width of less than or equal to 4 mm in order to keep the leakage field of the transformer small.

In order to make it possible to manufacture the ignition transformer in a simple manner and to make contact with the transformer windings in a simple manner with a physical separation of the high-voltage-conducting connection of the secondary winding, the secondary winding and the primary winding are preferably arranged one over the other, the secondary winding being arranged so as to lie on the inside, and the primary winding being arranged so as to lie on the outside. Preferably, the secondary winding is either wound directly onto the cylindrical section of the first core component or onto a coil former, which surrounds the abovementioned section of the first core component. The primary winding is preferably arranged over the secondary winding in such a way that it is separated by electrical insulation.

Preferably, a complete pulse ignition apparatus for the high-pressure discharge lamp is accommodated in the lamp base according to the invention. This pulse ignition apparatus comprises, in addition to the ignition transformer, also a spark gap or a threshold value element, via which the ignition capacitor is discharged when the breakdown voltage is exceeded. The breakdown voltage of the spark gap or of the threshold value element is advantageously in the range of from 400 V to 1500 V, and the turns ratio of the transformer windings is advantageously in the range of from 10 to 80. This ensures that, on the one hand, sufficiently high ignition voltage pulses of up to 30 kV can be generated with the aid of the pulse ignition apparatus and, on the other hand, no excessive power losses occur during lamp operation after the starting phase in the secondary winding, through which the lamp current flows. Preferably, the secondary winding of the ignition transformer is also designed for this purpose such that its DC resistance is less than 1 ohm.

In accordance with an exemplary embodiment of the invention, the ignition transformer has a coil former, which surrounds the cylindrical section of the first core component and on which at least one of the transformer windings is arranged, this coil former being provided with holding means for the at least one second core component. Alternatively, the holding means may be formed as part of a housing of the ignition transformer, in which housing, for example, the first core component and one or both windings of the transformer and possibly a coil former for the transformer windings are arranged.

The abovementioned holding means for the at least one second core component preferably comprise a snap-action or latching mechanism. As a result, the at least one second core component can be fixed in a simple manner in the predetermined position and orientation with respect to the first core component.

In accordance with a further exemplary embodiment of the invention, the at least one second core component of the ignition transformer is arranged in a cavity of the lamp base, with the result that the individual components of the ignition transformer are therefore fitted only when it is inserted in the lamp base. Preferably, the abovementioned cavity for the at least one second core component is located in one or more walls of the lamp base, which walls form a chamber for the ignition transformer or for the first core component of the ignition transformer with the windings arranged thereon. The at least one second core component of the transformer is therefore formed as part of the lamp base or the chamber wall, and the thus equipped walls of the chamber ensure optimum limitation of the magnetic leakage field of the ignition transformer once the first core component has been inserted in the chamber. Alternatively, the at least one second core component can be fixed in the abovementioned chamber by holding means, which are fitted to the lamp base. These holding means preferably comprise a snap-action or latching mechanism.

DETAILED DESCRIPTION OF THE DRAWINGS

Figure 1:
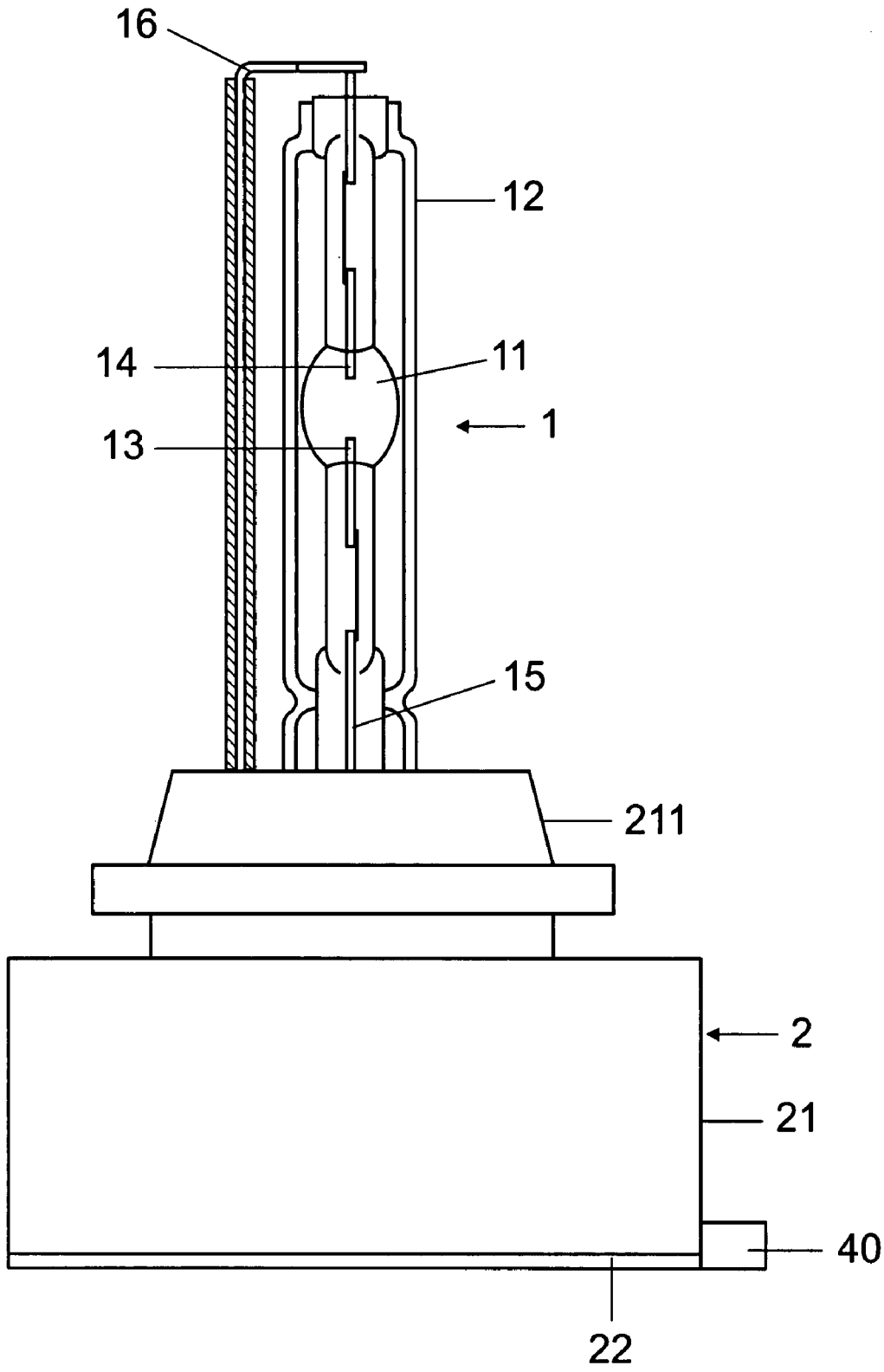
FIG. 1 shows a schematic side view of a high-pressure discharge lamp with the lamp base according to an embodiment of the invention.

The preferred exemplary embodiment of the high-pressure discharge lamp depicted in FIG. 1 is a metal-halide high-pressure discharge lamp, preferably a mercury-free metal-halide high-pressure discharge lamp for a motor vehicle headlamp.

This high-pressure discharge lamp has a discharge vessel 11, surrounded by a vitreous outer bulb 12, consisting of quartz glass and having electrodes 13, 14 arranged therein for generating a gas discharge. The electrodes 13, 14 are each connected to a power supply line 15 and 16, respectively, which are passed out of the discharge vessel 11 and via which the electrodes are supplied with electrical energy. The component unit 1 comprising the discharge vessel 11 and the outer bulb 12 is fixed in the lamp base 2. The lamp base 2 comprises a base outer part 21 and a cover 22, which closes the chambers of the base outer part 21, as well as a connection socket 40 for supplying voltage to the high-pressure discharge lamp. The base outer part 21 and the cover 22 as well as the socket housing 40 are surrounded by a two-part metal housing (not depicted). The metal housing has an opening in the form of a circular disk for the base upper part 211.

Figure 2:
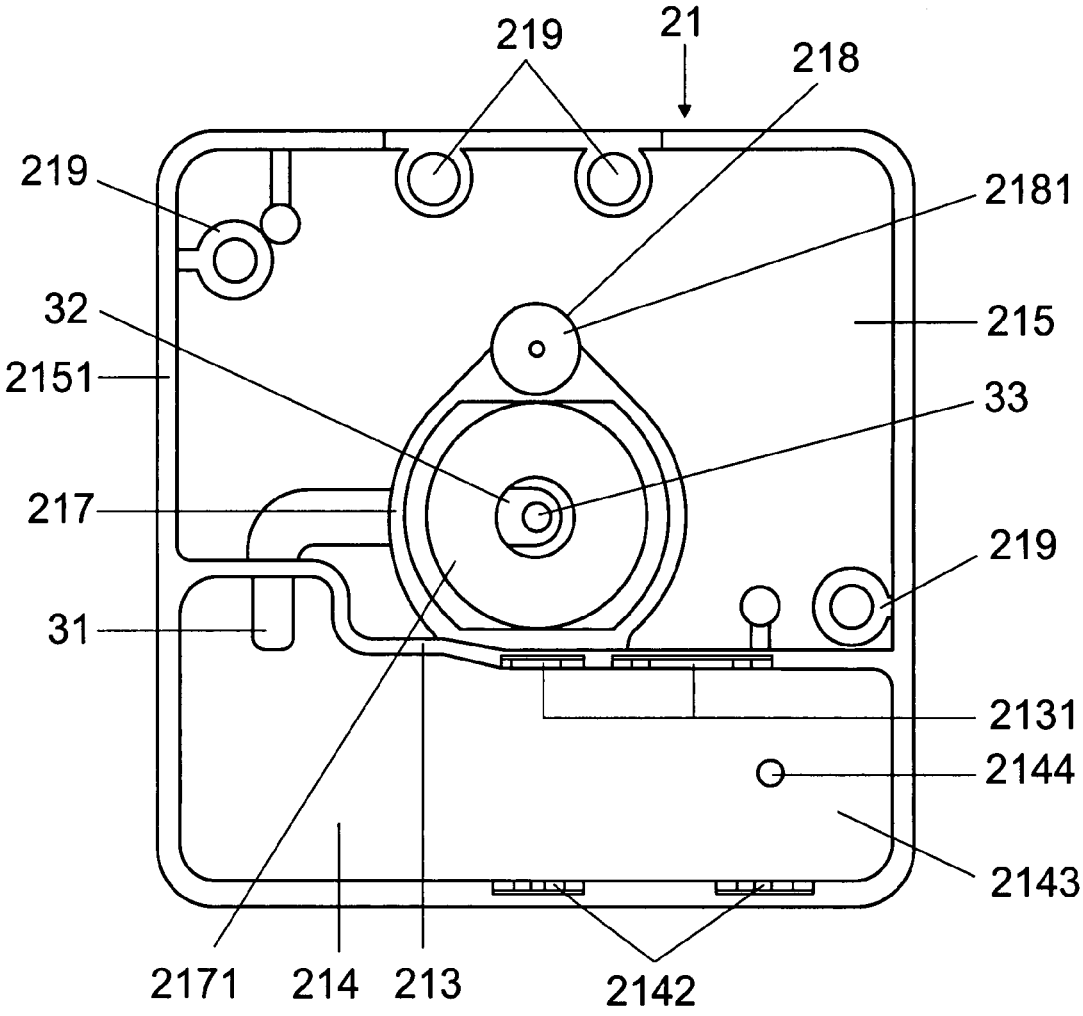
FIG. 2 shows a plan view of the interior of the lamp base of the high-pressure discharge lamp illustrated in FIG. 1.

The base outer part 21 has a substantially square cross section. The interior of the base outer part 21 depicted in FIG. 2 is split into two chambers 214, 215 of different sizes by a partitional wall 213. The transformer 1000, which acts as the ignition transformer for the pulse ignition apparatus accommodated in the lamp base 2 of the high-pressure discharge lamp, is fitted in the smaller, first chamber 214. Further components 61, 62 of the pulse ignition apparatus are arranged in the larger, second chamber 215. An electrical contact element is embedded in the base outer part 21. It consists of stainless steel and forms a component unit with the base outer part 21. Its ends 31, 32 have flat contact faces. The first end 31 of the electrical contact element extends into the first chamber 214 and, once the ignition transformer 1000 has been fitted, is welded to the high-voltage-conducting ignition voltage output of the ignition transformer 1000. The second end 32 of the electrical contact element, which is provided with a drilled through-hole 33 for the inner power supply line 15 of the high-pressure discharge lamp, extends into the second chamber 215. A trough 2171, which is delimited by a hollow-cylindrical web 217, is provided in the base outer part 21. The second end 32 of the contact element forms part of the trough bottom. Once the inner power supply line 15 has been welded to the second end 32 of the contact element, the trough 2171 is filled with an electrically insulating casting compound, with the result that the welded joint between the two lamp components 15, 32 is embedded in the casting compound. The end which is passed back into the base 2 of the outer power supply line 16, which protrudes out of that end of the discharge vessel 11 which is remote from the base, extends into the hollow-cylindrical web 218, which is likewise integrally formed on the base outer part 21. Further hollow-cylindrical webs 219 serve the purpose of fixing the cover 22 and of fixing the connection socket 40, which forms the electrical terminal of the high-pressure discharge lamp. The end of the web 218 is equipped with a resting face 2181 for a mounting board (not depicted), whose shape is matched to the cross section of the second chamber 215 so as to fit it. The mounting board closes the chamber 215 once it has been fitted. The components arranged on the mounting board, such as the ignition capacitor 61 and the spark gap 62 of the pulse ignition apparatus, for example, protrude into the second chamber 215. A plurality of grooves 2142, 2131 or guide webs for the ignition transformer 1000 are arranged in the side walls 2151, 213 of the first chamber 214. These grooves 2142, 2131 or guide webs are matched to the housing of the ignition transformer 1000, with the result that the position of the ignition transformer 1000 is thereby fixed in the first chamber 214. In addition, a knob 2144, which, together with the first end 31 of the contact element and the ignition voltage output resting thereon of the transformer 1000, determines the installation depth of the ignition transformer 1000, is located in the bottom 2143 of the chamber 214. The ignition voltage output of the ignition transformer is welded to this end 31. The ends of the primary winding are each connected to a conductor track on the mounting board. The ignition transformer 1000 rests on the knob 2144 acting as a spacer. The intermediate space between the ignition transformer 1000 and the side walls 2151, 213 of the first chamber 214 is filled with an electrically insulating casting compound. The cover 22 covers the mounting board and closes the two chambers 214, 215 of the base outer part 21.

Figure 3:
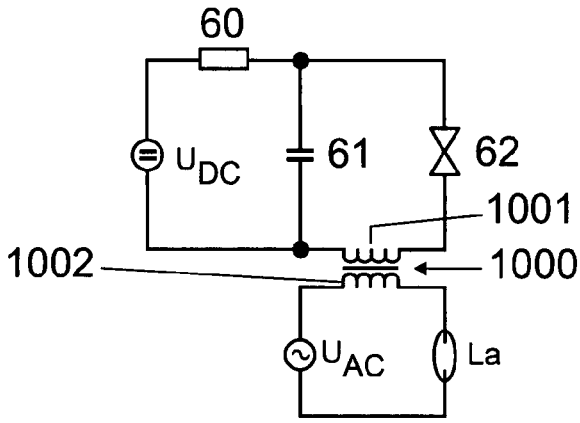
FIG. 3 shows a sketched circuit diagram of the pulse ignition apparatus accommodated in the lamp base.

FIG. 3 illustrates schematically a sketched circuit diagram of a pulse ignition apparatus, whose components 61, 62, 1000 are arranged in the lamp base 2. The pulse ignition apparatus is supplied with a DC voltage $U_{DC}$ by a voltage converter, which DC voltage charges the ignition capacitor 61 to the breakdown voltage of the spark gap 62 connected in parallel with the ignition capacitor 61 via the nonreactive resistor 60. The breakdown voltage of the spark gap 62 is 800 V. When the breakdown voltage is reached, the ignition capacitor 61 is discharged via the primary winding 1001 of the ignition transformer 1000. High-voltage pulses are thereby induced in the secondary winding 1002 of the ignition transformer 1000, which pulses result in the gas discharge in the high-pressure discharge lamp La being ignited. In the high-pressure discharge lamp La, an AC voltage $U_{AC}$ for operating the high-pressure discharge lamp is generated by means of a voltage converter from the on-board system voltage of the motor vehicle. Since the secondary winding 1002 is connected in series with the discharge path of the high-pressure discharge lamp, the lamp current flows through the secondary winding 1002 once the ignition phase of the high-pressure discharge lamp La has ended.

FIGS. 4 to 7 and 10 depict different embodiments of the ignition transformer arranged in the lamp base 2 or base outer part 21.

Figure 4:
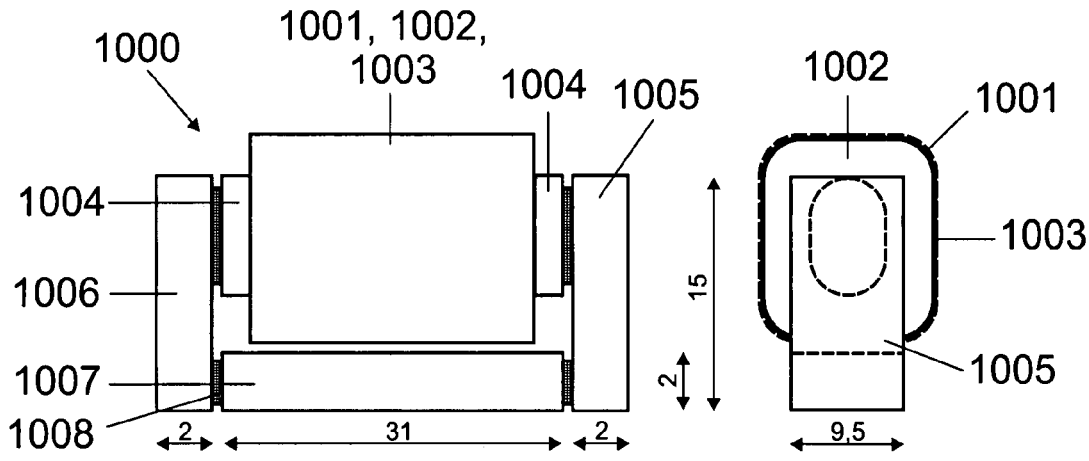
FIG. 4 shows a schematic illustration of two views of the ignition transformer in accordance with the first exemplary embodiment of the invention with dimensions.

FIG. 4 depicts schematically two views of the ignition transformer 1000 in accordance with the first exemplary embodiment. The ignition transformer 1000 has a cylindrical first core component 1004 with an oval cross section, on which the secondary winding 1002 of the ignition transformer 1000 has been wound. A coil former 1003 consisting of plastic has been arranged over the secondary winding 1002, on which coil former the primary winding 1001 of the ignition transformer 1000 has been wound. The coil former 1003 surrounds the first core component 1004 and the secondary winding 1002 wound thereon. The core of the ignition transformer 1000 is formed by the first core component 1004 and three further core components 1005, 1006, 1007, which are joined by means of adhesive 1008 to form a frame, which is only interrupted by the gap filled with adhesive 1008. The core components 1004 to 1007 are in the form of ferrite core components. The numerical values provided with arrows in FIG. 4 indicate the dimensions of the corresponding parts of the ignition transformer 1000 in millimeters. The gaps filled with adhesive 1008 are dimensioned such that the sum of their width is 0.1 mm. On average, therefore, each gap measures only 0.025 mm. The secondary winding 1002 has 135 turns, and the primary winding 1001 has 3 turns. The DC resistance of the secondary winding 1002 is 0.48 ohm. The secondary winding 1002 has an inductance of 1.4 mH. The three core components 1005, 1006 and 1007 may also be in the form of an integral, U-shaped ferrite component however, with the result that a gap filled with adhesive 1008 is only provided between the first core component 1004 and the respective U-limb.

Figure 5:
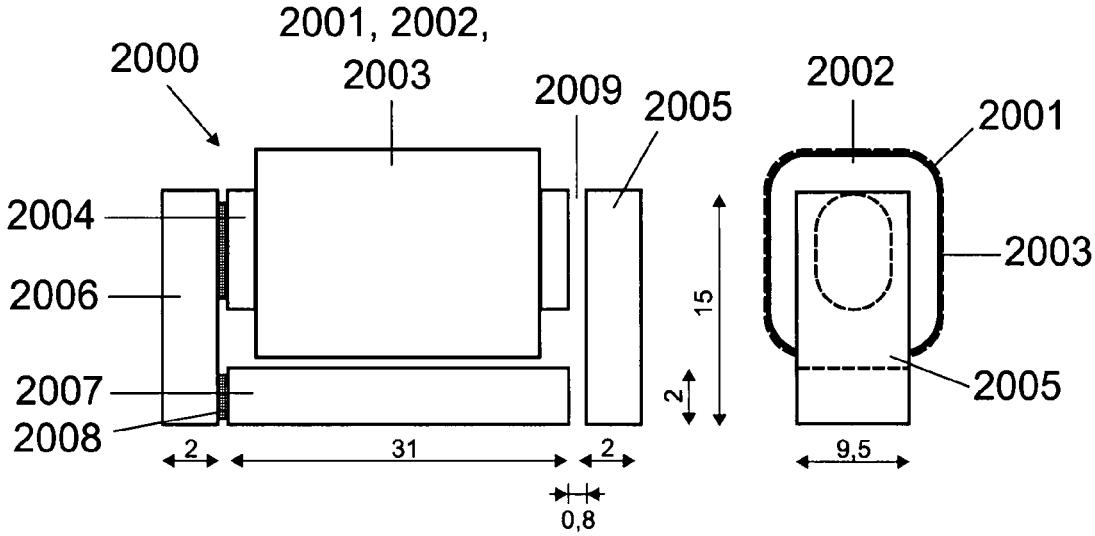
FIG. 5 shows a schematic illustration of two views of the ignition transformer in accordance with the second exemplary embodiment of the invention with dimensions.

FIG. 5 depicts schematically two views of the ignition transformer 2000 in accordance with the second exemplary embodiment. The ignition transformer 2000 has a cylindrical first core component 2004 with an oval cross section, on which the secondary winding 2002 of the ignition transformer 2000 has been wound. A coil former 2003 consisting of plastic has been arranged over the secondary winding 2002, on which coil former the primary winding 2001 of the ignition transformer 2000 has been wound. The coil former 2003 surrounds the first core component 2004 and the secondary winding 2002 wound thereon. The core of the ignition transformer 2000 is formed by the first core component 2004 and three further core components 2005, 2006, 2007. The core components 2004, 2006, 2007 are joined by means of adhesive 2008 to form a U shape. The core component 2005 forms the yoke for this U shape and is separated from the U shape by one or two air gaps 2009. The core components 2004 to 2007 form a frame, which is only interrupted by the gaps filled with adhesive 2008 and the air gaps 2009. The core components 2004 to 2007 are in the form of nickel-zinc ferrite core components. The numerical values provided with arrows in FIG. 5 indicate the dimensions of the corresponding parts of the ignition transformer 2000 in millimeters. The gaps filled with adhesive 2008 are dimensioned such that the sum of their width is 0.05 mm. The two air gaps 2009 have a width of in each case 0.8 mm. The secondary winding 2002 has 135 turns, and the primary winding 2001 has 4 turns. The DC resistance of the secondary winding 2002 is 0.48 ohm. The secondary winding 2002 has an inductance of 0.9 mH. The transformer core is held together, for example, by means of a housing, which surrounds the entire transformer 2000, or by means of holders fitted to the coil former 2003 for the yoke 2005 or by means of a casting compound arranged in the chamber 214 of the lamp base 2. In the region of the air gaps 2009, the metallic shielding housing (not depicted), which surrounds the base part 21, preferably has an aperture in order to reduce the interaction of the magnetic lines of force emerging from the air gaps 2009 with the shielding housing.

Figure 6:
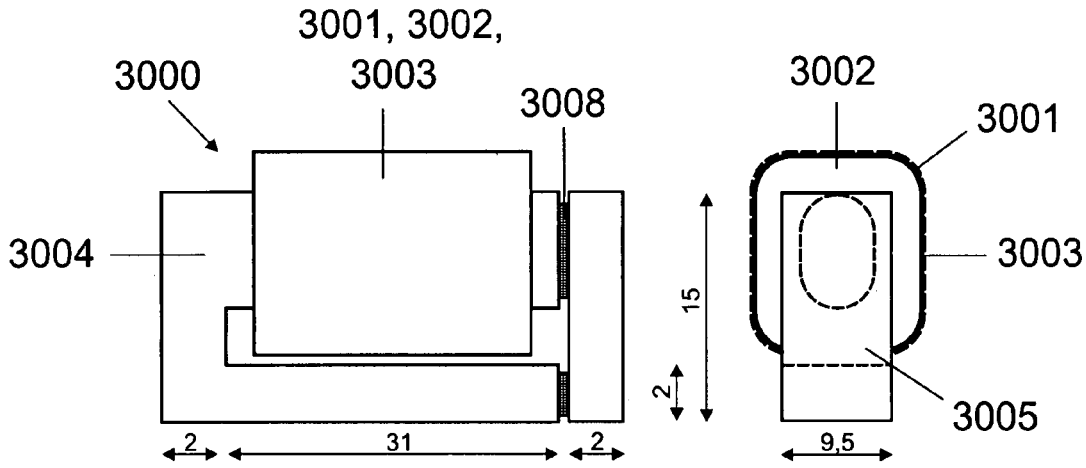
FIG. 6 shows a schematic illustration of two views of the ignition transformer in accordance with the third exemplary embodiment of the invention with dimensions.

FIG. 6 depicts schematically two views of the ignition transformer 3000 in accordance with the third exemplary embodiment. The ignition transformer 3000 has a first, substantially U-shaped core component 3004. A U limb of the first core components 3004, onto which the secondary winding 3002 of the ignition transformer 3000 has been wound, has an oval cross section. It is cylindrical.

A coil former 3003 consisting of plastic has been arranged over the secondary winding 3002, onto which coil former the primary winding 3001 of the ignition transformer 3000 has been wound. The coil former 3003 surrounds the abovementioned cylindrical U limb of the first core component 3004 and the secondary winding 3002 wound thereon. The core of the ignition transformer 3000 is formed by the U-shaped first core component 3004 and the second core component 3005 in the form of a yoke, which core components are joined by means of adhesive 3008 to form a frame, which is only interrupted by the two gaps filled with adhesive 3008. The core components 3004 and 3005 are in the form of ferrite core components. The numerical values provided with arrows in FIG. 6 indicate the dimensions of the corresponding parts of the ignition transformer 3000 in millimeters. The gaps filled with adhesive 3008 are dimensioned such that the sum of their width is 1 mm. On average, each gap therefore measures only 0.5 mm. The secondary winding 3002 has 135 turns, and the primary winding 3001 has 3 turns. The DC resistance of the secondary winding 3002 is 0.48 ohm.

Figure 7:
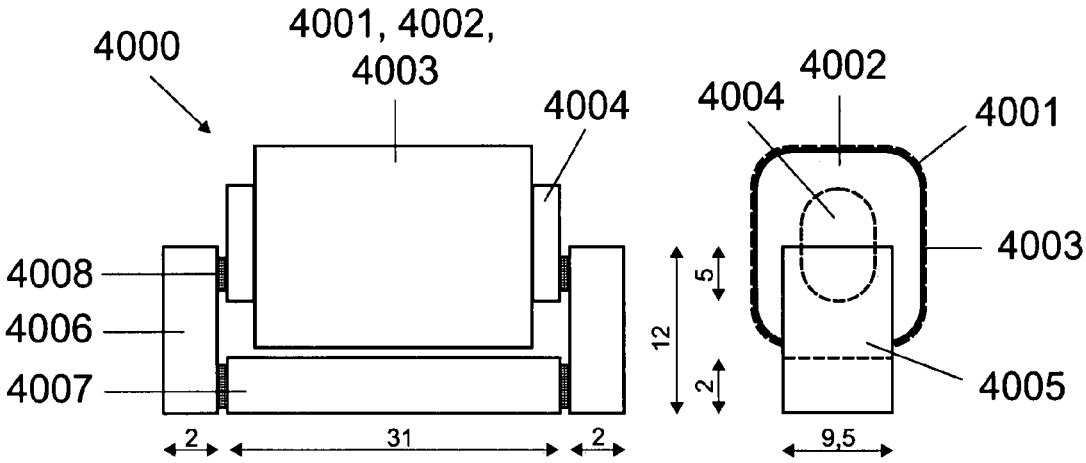
FIG. 7 shows a schematic illustration of two views of the ignition transformer in accordance with the fourth exemplary embodiment of the invention with dimensions.

FIG. 7 depicts schematically two views of the ignition transformer 4000 in accordance with the fourth exemplary embodiment. The ignition transformer 4000 has a cylindrical first core component 4004 with an oval cross section, on which the secondary winding 4002 of the ignition transformer 4000 has been wound. A coil former 4003 consisting of plastic has been arranged over the secondary winding 4002, on which coil former the primary winding 4001 of the ignition transformer 4000 has been wound. The coil former 4003 surrounds the first core component 4004 and the secondary winding 4002 wound thereon. The core of the ignition transformer 4000 is formed by the first core component 4004 and three further core components 4005, 4006, 4007, which are joined by means of adhesive 4008 to form a frame, which is only interrupted by the gaps filled with adhesive 4008. The core components 4004 to 4007 are in the form of ferrite core components. The numerical values provided with arrows in FIG. 7 indicate the dimensions of the corresponding parts of the ignition transformer 4000 in millimeters. The gaps filled with adhesive 4008 are dimensioned such that the sum of their width is 0.1 mm. On average, each gap therefore measures only 0.025 mm. The secondary winding 4002 has 135 turns and the primary winding 4001 has 3 turns. The DC resistance of the secondary winding 4002 is 0.48 ohm. The only difference with respect to the first exemplary embodiment consists in the smaller longitudinal dimensions of the ferrite core components 4005 and 4006.

Figure 10:
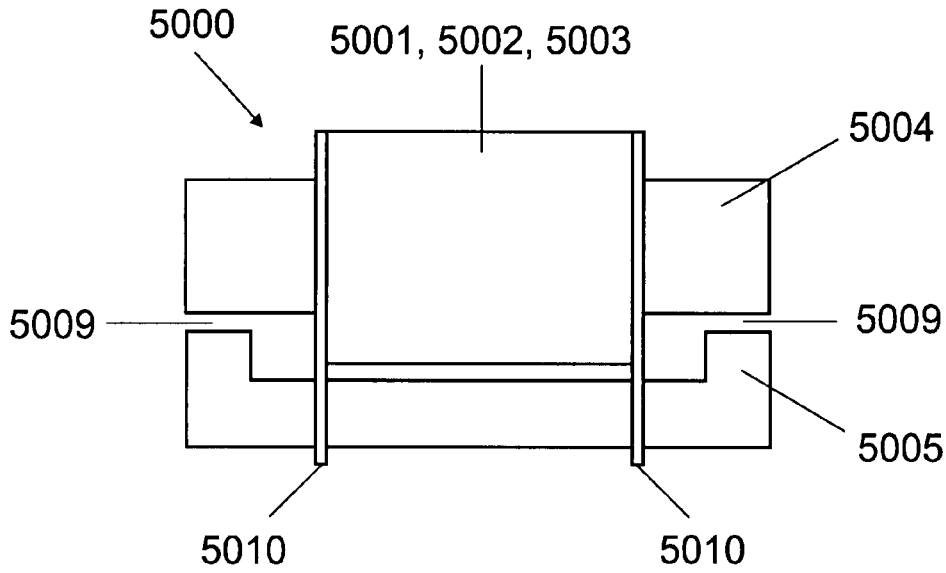
FIG. 10 shows a schematic illustration of two views of the ignition transformer in accordance with the fifth exemplary embodiment of the invention.

FIG. 10 depicts schematically the ignition transformer 5000 in accordance with the fifth exemplary embodiment. The ignition transformer 5000 has a cylindrical first core component 5004 with an oval cross section, on which the secondary winding 5002 of the ignition transformer 5000 has been wound. A coil former 5003 consisting of plastic has been arranged over the secondary winding 5002, on which coil former the primary winding 5001 of the ignition transformer 5000 has been wound. The coil former 5003 surrounds the first core component 5004 and the secondary winding 5002 wound thereon. The core of the ignition transformer 5000 is formed by the first core component 5004 and a further, substantially U-shaped core component 5005. The short U limbs of the second core component 5005 face those ends of the first core component 5004 which protrude out of the coil former 5003, with the result that the core components 5004, 5005 form a frame, which is only interrupted by the two air gaps 5009 between the U limbs of the second core component 5005 and the ends of the first core component 5004. The core components 5004 and 5005 are in the form of ferrite core components. The numerical values provided with arrows in FIG. 7 indicate the dimensions of the corresponding parts of the ignition transformer 5000 in millimeters. The two air gaps 5009 have a width of in each case 2 mm. The secondary winding 5002 has 135 turns, and the primary winding 5001 has 4 turns. The DC resistance of the secondary winding 5002 is 0.48 ohm. The coil former 5003 is provided with four sprung, clip-like holders 5010 for the second core component 5005 whose free ends are bent back. The four holders 5010 make it possible to fix the core component 5005 by means of a snap-action mechanism. At a distance from the hook-shaped free ends of the holders 5010, which corresponds to the thickness of the base of the U-shaped core component 5005, knobs are provided on the holders, with the result that the base of the U-shaped core component 5005 is held in the case of each holder between its hook-shaped end and the respective knob.

Figure 8:
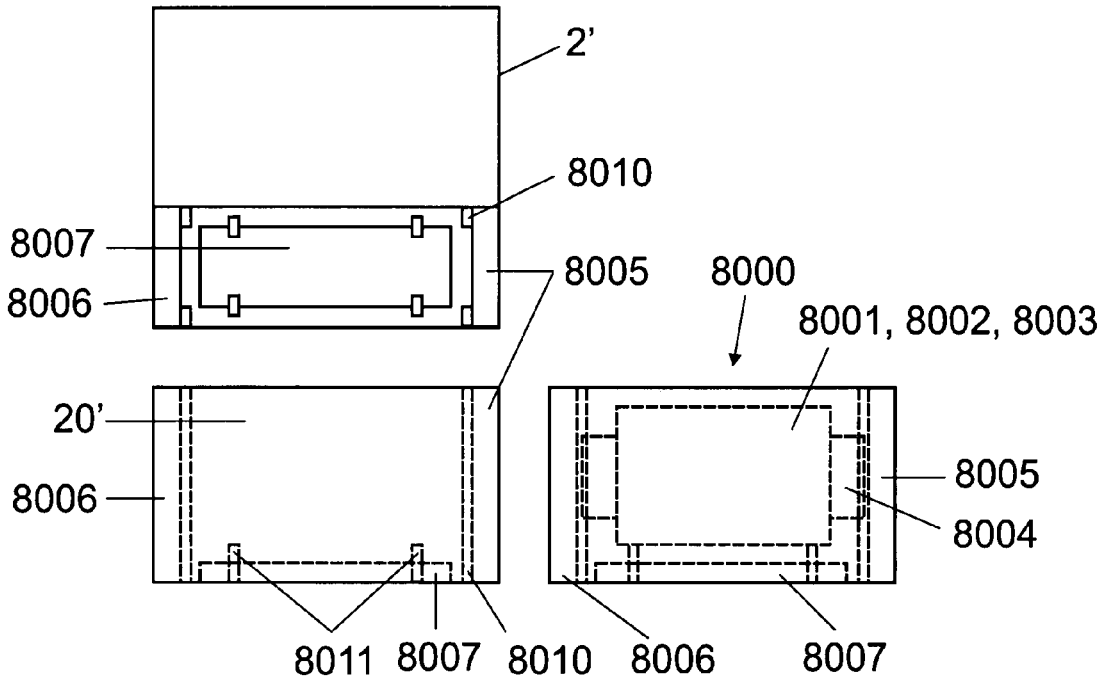
FIG. 8 shows a schematic illustration of three view of the lamp base with the ignition transformer in accordance with the sixth exemplary embodiment of the invention.

FIG. 8 illustrates schematically three views of the sixth exemplary embodiment of the ignition transformer 8000 and the lamp base 2'. The ignition transformer 8000 has a cylindrical first core component 8004 with an oval cross section, on which the secondary winding 8002 of the ignition transformer 8000 has been wound. A coil former 8003 consisting of plastic has been arranged over the secondary winding 8002, on which coil former the primary winding 8001 of the ignition transformer 8000 has been wound. The coil former 8003 surrounds the first core component 8004 and the secondary winding 8002 wound thereon. The core of the ignition transformer 8000 is formed by the first ferrimagnetic core component 8004 and three further core components 8005, 8006, 8007 in the form of ferrite plates. The ferrite plates 8005 and 8006 are fixed in the lamp base by means of guide journals or guide strips 8010 on two opposite lateral inner walls of the chamber 20', in which the first core component 8004 with the transformer windings 8001, 8002 located thereon and the coil former 8003 is arranged. Holders 8011 for the ferrite plate 8007 lying on the bottom are fitted to the bottom of this chamber 20' (FIG. 8, illustrations on the left, without the first core component). Once the first core component 8004 with the transformer windings 8001, 8002 located thereon and the coil former 8003 has been inserted into the chamber 20', the transformer 8000 is fitted completely for the first time (FIG. 8, illustration on the right). The installation height of the transformer 8000 is determined by the holders 8011. The core components 8004 to 8007 form a frame, which is only interrupted by narrow gaps filled with casting compound or air.

Figure 9:
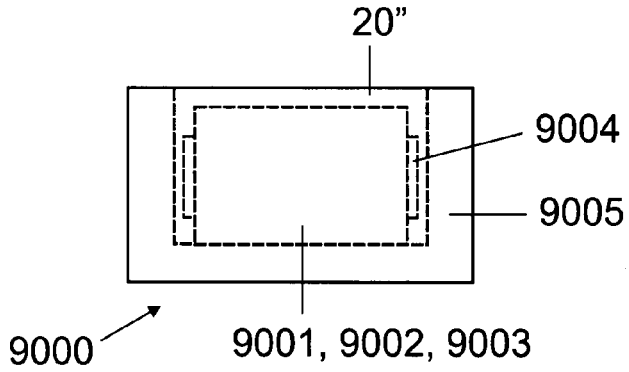
FIG. 9 shows a schematic illustration of the lamp base with the ignition transformer in accordance with the seventh exemplary embodiment of the invention.

FIG. 9 illustrates schematically the seventh exemplary embodiment of the ignition transformer 9000 and the chamber 20" in the lamp base for the ignition transformer 9000. The ignition transformer 9000 has a cylindrical first core component 9004 with an oval cross section, on which the secondary winding 9002 of the ignition transformer 9000 has been wound. A coil former 9003 consisting of plastic has been arranged over the secondary winding 9002, on which coil former the primary winding 9001 of the ignition transformer 9000 has been wound. The coil former 9003 surrounds the first core component 9004 and the secondary winding 9002 wound thereon. The core of the ignition transformer 9000 is formed by the first, ferrimagnetic core component 8004 and a U-shaped cavity filled with ferrite powder 9005. This cavity 9005 extends over two opposite side walls and the bottom of the chamber 20", in which the first core component 9004, which is equipped with the transformer windings 9001, 9002, is arranged.

Figure 11:
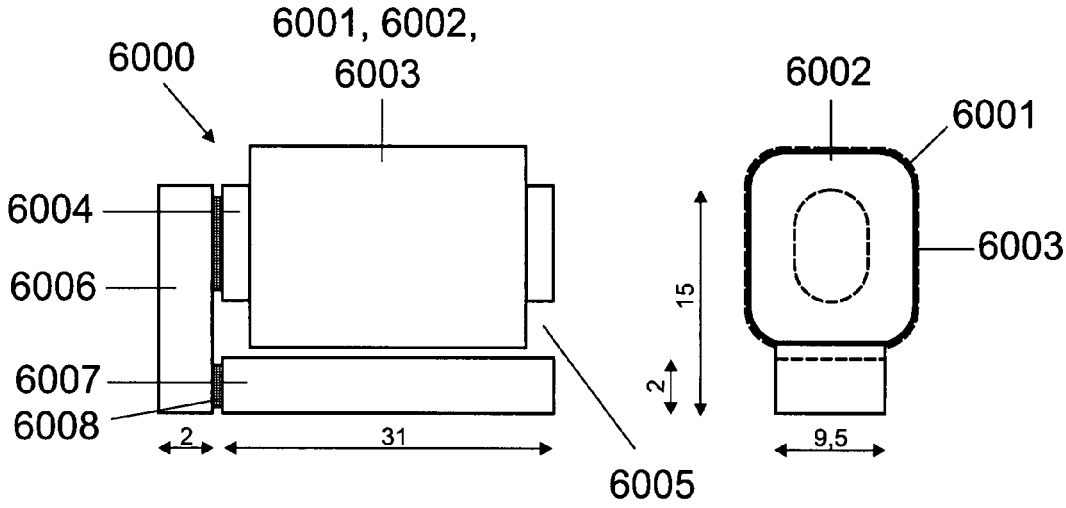
FIG. 11 shows a schematic illustration of two views of the ignition transformer in accordance with the sixth exemplary embodiment of the invention with dimensions.

FIG. 11 depicts schematically two views of the ignition transformer 6000 in accordance with the sixth exemplary embodiment. The ignition transformer 6000 has a cylindrical first core component 6004 with an oval cross section, on which the secondary winding 6002 of the ignition transformer 6000 has been wound. A coil former 6003 consisting of plastic has been arranged over the secondary winding 6002, on which coil former the primary winding 6001 of the ignition transformer 6000 has been wound. The coil former 6003 surrounds the first core component 6004 and the secondary winding 6002 wound thereon. The core of the ignition transformer 6000 is formed by the first core component 6004 and two further core components 6006, 6007. The core components 6004, 6006, 6007 are joined by means of adhesive 6008 to form a U shape. The core components 6004, 6006, 6007 are in the form of nickel-zinc ferrite core components. The numerical values provided with arrows in FIG. 11 indicate the dimensions of the corresponding parts of the ignition transformer 6000 in millimeters. The gaps filled with adhesive 6008 are dimensioned such that the sum of their width is 0.05 mm. The air gap 6005 between the free end of the first core component 6004 and the free end of the third core component 6007, which is aligned parallel with the first core component 6004, is 3.2 mm. The secondary winding 6002 has 135 turns, and the primary winding 6001 has 4 turns. The DC resistance of the secondary winding 6002 is 0.48 ohm. The secondary winding 6002 has an inductance of 0.9 mH.

The invention is not restricted to the exemplary embodiments explained in more detail above. For example, a semicircular core component can be used in place of the U-shaped core component 5005 in FIG. 10. However, any desired other shapes and combinations of core components are also possible in order to realize a largely closed transformer core, which is only interrupted by relatively narrow gaps.

The invention is particularly suitable for mercury-free metal-halide high-pressure discharge lamps which are used as a light source in vehicle headlamps. However, the lamp base according to the invention can also be used for other types of high-pressure discharge lamp, in particular also for mercury-containing metal-halide high-pressure discharge lamps.

The invention claimed is:

1. A lamp base for a high-pressure discharge lamp, the lamp base having an ignition transformer arranged in an interior of the lamp base for igniting gas discharge in the high-pressure discharge lamp, wherein the ignition transformer comprises a first core component and at least one second core component, the first core component having a cylindrical section, on which windings of the ignition transformer are arranged;

wherein the first and second core components each comprise a ferromagnetic or ferrimagnetic material and are separated by at least one gap, the first and second core components being shaped such that the at least one second core component bridges the cylindrical section of the first core component and produces a magnetic return path from a first end of the first core component to a second end of the first core component; and wherein an adhesive material having a lower relative permeability than that of the ferromagnetic or ferrimagnetic material of the first and second core components is arranged in the at least one gap for connecting the first and second core components.

2. The lamp base as claimed in claim 1, wherein the first and second core components are arranged in the form of a U.

3. The lamp base as claimed in claim 1, wherein the first and second core components form a frame, which is only interrupted by the at least one gap.

4. The lamp base as claimed in claim 1, wherein the first and second core components are in the form of nickel-zinc ferrite core components.

5. The lamp base as claimed in claim 1, wherein the at least one gap is in the form of an air gap.

6. The lamp base as claimed in claim 1, wherein the at least one gap has a width of less than or equal to 4 mm.

7. The lamp base as claimed in claim 1, wherein the windings comprise a primary winding and a secondary winding arranged one over the other, the secondary winding being arranged so as to lie on an inside, and the primary winding being arranged so as to lie on an outside.

8. The lamp base as claimed in claim 1, wherein the at least one second core component is arranged in a cavity of the lamp base.

9. The lamp base as claimed in claim 8, wherein the cavity is arranged in one or more walls of the lamp base, which walls delimit a chamber for the first core component of the ignition transformer.

10. The lamp base as claimed in claim 1, wherein the lamp base has means for holding the at least one second core component.

11. A high-pressure discharge lamp having a lamp base as claimed in claim 1.

12. A lamp base for a high-pressure discharge lamp, the lamp base having an ignition transformer arranged in an interior of the lamp base for igniting gas discharge in the high-pressure discharge lamp, wherein the ignition transformer comprises a first core component and at least one second core component, the first core component having a cylindrical section, on which windings of the ignition transformer are arranged;

wherein the first and second core components each comprise a ferromagnetic or ferrimagnetic material and are separated by at least one gap, the first and second core components being shaped such that the at least one second core component bridges the cylindrical section of the first core component and produces a magnetic return path from a first end of the first core component to a second end of the first core component; and wherein the windings comprise a secondary winding having a DC resistance of less than or equal to 1 ohm.

13. A lamp base for a high-pressure discharge lamp, the lamp base having an ignition transformer arranged in an interior of the lamp base for igniting gas discharge in the high-pressure discharge lamp, wherein the ignition transformer comprises a first core component and at least one second core component, the first core component having a cylindrical section, on which windings of the ignition transformer are arranged;

wherein the first and second core components each comprise a ferromagnetic or ferrimagnetic material and are separated by at least one gap, the first and second core components being shaped such that the at least one second core component bridges the cylindrical section of the first core component and produces a magnetic return path from a first end of the first core component to a second end of the first core component; and wherein the ignition transformer has a coil former, which surrounds the cylindrical section of the first core component and on which at least one of the windings of the ignition transformer is arranged, the coil former being equipped with means for holding the at least one second core component.

14. The lamp base as claimed in claim 13, wherein the means for holding the at least one second core component comprise a snap-action or latching mechanism.

15. A lamp base for a high-pressure discharge lamp, the lamp base having an ignition transformer arranged in an interior of the lamp base for igniting gas discharge in the high-pressure discharge lamp, wherein the ignition transformer comprises a first core component and at least one second core component, the first core component having a cylindrical section, on which windings of the ignition transformer are arranged;

wherein the first and second core components each comprise a ferromagnetic or ferrimagnetic material and are separated by at least one gap, the first and second core components being shaped such that the at least one second core component bridges the cylindrical section of the first core component and produces a magnetic return path from a first end of the first core component to a second end of the first core component; and wherein the ignition transformer has a housing in which at least the first core component is arranged, the housing being equipped with means for holding the at least one second core component.

16. The lamp base as claimed in claim 15, wherein the means for holding the at least one second core component comprise a snap-action or latching mechanism.

17. A lamp base for a high-pressure discharge lamp, the lamp base comprising:

an ignition transformer arranged in an interior of the lamp base for igniting gas discharge in the high-pressure discharge lamp, and a spark gap or a threshold value element arranged in the interior of the lamp base, wherein the ignition transformer comprises a first core component and at least one second core component, the first core component having a cylindrical section, on which windings of the ignition transformer are arranged;

wherein the first and second core components each comprise a ferromagnetic or ferrimagnetic material and are separated by at least one gap, the first and second core components being shaped such that the at least one second core component bridges the cylindrical section of the first core component and produces a magnetic return path from a first end of the first core component to a second end of the first core component; and wherein the spark gap or the threshold value element is formed as part of a pulse ignition apparatus, a breakdown voltage of the spark gap or of the threshold value element being in the range of from 400 V to 1500 V, and the ratio of turns numbers of a secondary winding to a primary winding of the ignition transformer being in the range of from 10 to 80.

18. A lamp base for a high-pressure discharge lamp, the lamp base comprising an ignition transformer arranged in an interior of the lamp base for igniting gas discharge in the high-pressure discharge lamp, wherein the ignition transformer comprises a first core component and at least one second core component, the first core component having a cylindrical section, on which windings of the ignition transformer are arranged;

wherein the first and second core components each comprise a ferromagnetic or ferrimagnetic material and are separated by at least one gap, the first and second core components being shaped such that the at least one second core component bridges the cylindrical section of the first core component and produces a magnetic return path from a first end of the first core component to a second end of the first core component;

wherein the lamp base has means for holding the at least one second core component; and wherein the means for holding the at least one second core component comprise a snap-action or latching mechanism.

19. The lamp base as claimed in claim 18, wherein a material having a lower relative permeability than that of the ferromagnetic or ferrimagnetic material of the first and second core components is arranged in the at least one gap.

20. The lamp base as claimed in claim 19, wherein the material having a lower relative permeability is an adhesive material for connecting the first and second core components.

* * * * *